United States Patent [19]

Santo

[11] 4,181,990

[45] Jan. 8, 1980

[54] PERIMETER SUPPORT FOR A WATERBED MATTRESS

[76] Inventor: Philip J. Santo, 100 Fernwood Ave., Rochester, N.Y. 14621

[21] Appl. No.: 896,036

[22] Filed: Apr. 13, 1978

[51] Int. Cl.[2] ..... A47C 27/08; A47G 9/00

[52] U.S. Cl. ..... 5/452; 5/450; 5/455; 5/474

[58] Field of Search ..... 5/371, 365, 367, 368, 5/370, 349, 350, 340, 341; 128/376

[56] References Cited

U.S. PATENT DOCUMENTS

| | | | |
|---|---|---|---|
| 2,360,715 | 10/1944 | Perry | 5/365 |
| 2,586,031 | 2/1952 | Hatine | 5/340 |
| 4,079,473 | 3/1978 | Phillips | 128/376 |

FOREIGN PATENT DOCUMENTS

| | | | |
|---|---|---|---|
| 159299 | 2/1921 | United Kingdom | 5/368 |

*Primary Examiner*—Mervin Stein
*Assistant Examiner*—Alexander Grosz
*Attorney, Agent, or Firm*—Lawrence P. Kessler

[57] ABSTRACT

An improved perimeter support for a waterbed mattress. Sleeves are fixed to the liquid-containing bladder to be co-extensive with the marginal edge of the bladder. The sleeves are joined externally to the bladder so that the interconnecting seams are not adversely effected by action of, and reaction with, the liquid within the bladder. A self-contained chamber, filled with air or foam material, is slidably retained within each sleeve. The chamber provides sufficient lateral support for the bladder for effective body support; and if any one of the chambers is damaged, it can readily be replaced without having to replace the entire mattress.

3 Claims, 3 Drawing Figures

PERIMETER SUPPORT FOR A WATERBED MATTRESS

BACKGROUND OF THE INVENTION

1. Field of the Invention

This invention relates generally to waterbed mattress, and more particularly to a perimeter support for a waterbed mattress.

2. Description of the Prior Art

Waterbeds have become a popular alternative to conventional type bedding because of their superior relaxation inducing properties. Generally a waterbed has a flexible bladder filled with liquid such as water. The body supported by the mattress displaces fluid in the bladder until an equilibrium condition is established to provide uniform pressure support of the body. However, since the flexible bladder has soft sides, the mattress must be laterally supported about its perimeter to maintain the mattress at a pre-selected uniform height to permit a body to be effectively supported by the mattress without "bottoming out". When the mattress "bottoms out", the pressure distribution supporting the body is no longer uniform and the beneficial aspects of the waterbed are negated. One type of perimeter support is a solid frame about the periphery of the bladder. However, solid frames are uncomfortable to one sitting on the bedside or getting in or out of the bed, and do not readily accept conventional bed clothes.

To overcome these problems, a perimeter chamber filled with air or foam material has typically been provided as shown in U.S. Pat. Nos. 3,840,921 and 4,006,501. As shown in these patents the air or foam material in the perimeter chamber accomplishes the desired results of providing sufficient lateral support to maintain the mattress at a pre-selected uniform height while being comfortable to one sitting on the bedside or getting in and out of the bed. However, in the known perimter chamber waterbed mattresses, the chamber has been formed integrally with the liquid-containing bladder of the mattress. Thus, when the perimeter chamber is damaged such as by an external puncturing of the chamber, the entire mattress must be replaced. Further when there is an internal failure of the chamber seams due to action of, or reaction with, the liquid, the liquid enters the chamber and destroys its effectiveness as a perimeter support (again requiring the entire mattress to be replaced).

SUMMARY OF THE INVENTION

In accordance with this invention, a perimeter support is provided for a waterbed mattress wherein damage to a portion of the perimeter support does not result in the entire mattress having to be replaced. Sleeves are fixed to the liquid containing bladder to be co-extensive with the marginal edges of the bladder. The sleeves are joined externally to the bladder so that the interconnecting seams are not adversely effected by the action of, or reaction with, the liquid within the bladder. A self-contained chamber filled with air or foam material is slidably retained within each sleeve. The chamber provides sufficient lateral support for the bladder for effective body support; and if any one of the chambers is damages, it can readily be replaced without having to replace the entire mattress.

BRIEF DESCRIPTION OF THE DRAWINGS

In the desired description of the preferred embodiment of the invention presented below, reference is made to the accompanying drawings, in which.

DESCRIPTION OF THE PREFERRED EMBODIMENT

Figure 1:
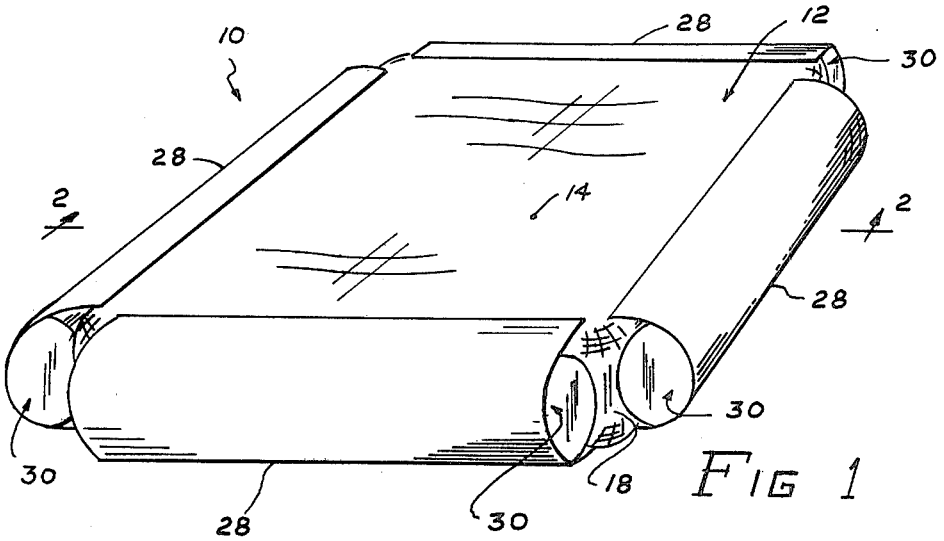
FIG. 1 is a view in perspective of the waterbed mattress incorporating the perimeter support according to this invention.
Figure 2:
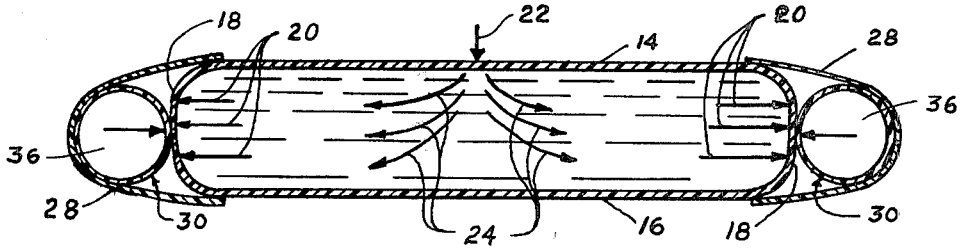
FIG. 2 is a side elevational view in section of the waterbed mattress taken along lines 2—2 of FIG. 1.

Referring now to the drawings, a waterbed mattress is shown and designated generally as numeral 10 in FIGS. 1 and 2. The waterbed mattress 10 comprises a bladder 12 containing a fluid. The bladder 12 is formed of a material which is both flexible and impervious to the fluid contained therein, as for example rubber or vinyl. The bladder 12 is configured so as to have substantially parallel planar surfaces 14 and 16. The surface 16 forms a base or bottom for the mattress, and the surface 14 provides a body-supporting surface. The surfaces 14 and 16 are interconnected by substantially vertical side walls 18.

The fluid within the bladder 12 exerts a force represented by arrows 20 on the walls 18. Additionally, when a body is supported on the surface 14, a force represented by arrow 22 exerted on the mattress 10 is transmitted through the fluid within the bladder as indicated by the arrows 24. Without a perimeter support about the side walls 18, the forces 20 and 24 would case the walls to bow outwardly. Outward bowing of the side walls effectively reduces the operative height of the mattress leaving it with the undesirable tendency to "bottom out" when supporting a body. When the mattress "bottoms out", the pressure distribution supporting the body is no longer uniform and the beneficial aspects of the waterbed are negated.

In the instant invention, the perimeter of the mattress 10 established by side walls 18 is supported in the following manner. Substantially C-shaped sleeves 28 are fixed to the marginal edges of the surfaces 14 and 16, and extend therebetween to be co-extensive with and spaced from the side walls 18. The sleeves 28 are formed of a sheet material which is flexible but of relatively stable dimensions under tension, such as vinyl. The material is attached to the external surface of bladder 12 by any known methods such as heat sealing or gluing. By externally joining the sleeves 28 to the bladder 12, the interconnecting seams are not subjected to wave action of, or chemical reactions with, the fluid within the bladder. By locating the seams externally, the problem of seam deterioration experienced by the prior art integral support chambers is eliminated.

Figure 3:
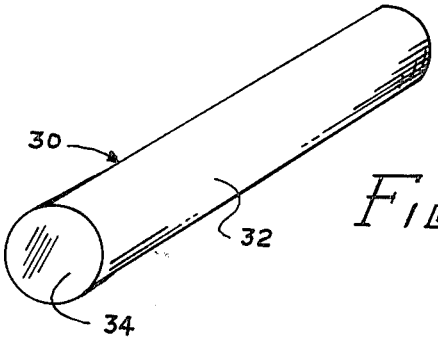
FIG. 3 is a view in perspective of the perimeter support chamber.

Self-contained chambers 30 are slidably retained within the sleeves 28 between the sleeves and the side walls 18. Each of the chambers 30 has a substantially cylindrical housing 32 sealed at both ends by end caps 34 (see FIG. 3). The housing 32 contains a compressible medium 36 such as air or foamed urethane. Because each of the chambers 30 is an independent unit, damage to one chamber does not require the entire matress to be replaced as in the prior art perimeter supports. The damaged chamber is merely sliped out of its respective sleeve and a new chamber inserted.

When the chambers 30 are positioned within the sleeves 28, the sleeves maintain the chambers in intimate contact with side walls 18. Since the sleeves are dimensionally stable, they urge the chambers toward the side walls to counteract the force 20 (and 24) to provide the necessary support for the side walls 18. The degree of compressibility of the medium within the chambers 30 is particularly selected to provide the necessary counteractive force for supporting the side walls without making the chambers so hard as to be uncomfortable to the user of the waterbed 10.

The invention has been described in detail with particular reference to preferred embodiments thereof, but it will be understood that variations and modifications can be effected within the spirit and scope of the invention.

I claim:

1. In a waterbed having a flexible liquid-containing bladder, said bladder having upper and lower surfaces with a plurality of substantially vertical side walls interconnecting said upper and lower surface, such liquid within said bladder exerting lateral forces on said side walls, a perimeter support for said side walls, said perimeter support comprising:

at least two sleeves connected to said upper and lower surfaces of said bladder to be co-extensive with at least two of said plurality of side walls respectively, said sleeves formed of a sheet of flexible material, of stable dimensions under tension, attached to the external surface of said bladder adjacent to the marginal edges of said upper and lower marginal edges of said surfaces so as to be coextensive with said vertical side walls; and at least two self contained chambers encasing a compressible medium, said chambers slidably retained within said sleeves respectively and bearing against said sleeves and said vertical side walls so that said sleeves urge said chambers against said side walls to counteract said lateral forces exerted by such liquid, thereby providing support for said side walls.

2. The invention of claim 1 wherein said compressible medium is air.

3. The invention of claim 1 wherein said compressible medium is foam material.

* * * * *